US006671229B2

(12) United States Patent
Schmidt

(10) Patent No.: US 6,671,229 B2
(45) Date of Patent: Dec. 30, 2003

(54) TORPEDO SONAR COMPRISING A PLURALITY OF ACOUSTIC TRANSDUCERS

(75) Inventor: Joerg Schmidt, Eckernfoerde (DE)

(73) Assignee: L-3 Communications Elac Nautik GmbH, Kiel (DE)

( * ) Notice: Subject to any disclaimer, the term of this patent is extended or adjusted under 35 U.S.C. 154(b) by 0 days.

(21) Appl. No.: 10/316,390

(22) Filed: Dec. 11, 2002

(65) Prior Publication Data

US 2003/0117897 A1 Jun. 26, 2003

Related U.S. Application Data

(63) Continuation of application No. 10/051,329, filed on Oct. 22, 2001, now abandoned.

(30) Foreign Application Priority Data

Nov. 8, 2000 (DE) ..... 100 55 164

(51) Int. Cl.[7] ..... H04R 1/00
(52) U.S. Cl. ..... 367/153; 114/20.1
(58) Field of Search ..... 367/153; 114/20.1, 114/21.3

(56) References Cited

U.S. PATENT DOCUMENTS 3,145,679 A * 8/1964 Brooks ..... 367/153
3,492,634 A * 1/1970 Massa ..... 367/153
3,906,431 A * 9/1975 Clearwaters et al. ..... 367/122
4,449,211 A * 5/1984 Schmidt et al. ..... 367/153
4,989,530 A * 2/1991 Thompson et al. ..... 114/21.3
5,527,480 A * 6/1996 Bailey et al. ..... 252/62.9 PZ
5,602,801 A * 2/1997 Nussbaum et al. ..... 367/153
5,706,253 A * 1/1998 Nedderman, Jr. ..... 367/153

FOREIGN PATENT DOCUMENTS

DE 33 22 246 * 2/1988
GB 2 234 815 * 2/1991

* cited by examiner

*Primary Examiner*—Ian J. Lobo
(74) *Attorney, Agent, or Firm*—Herbert Dubno

(57) ABSTRACT

For reducing the number of acoustic transducers required by a torpedo sonar for target searching, the transducers are arranged in four particular zones at the curved contour of the torpedo bow forming a conformal sonar array. The circular first zone covers the vertex region of the torpedo bow and is surrounded by a ring-shaped second zone. Extending from the second zone on both sides of the torpedo are third lateral transition zones, which change over into fourth lateral zones of constant width ending at the great circle of the hemispherical or paraboloid-shaped torpedo head.

14 Claims, 2 Drawing Sheets

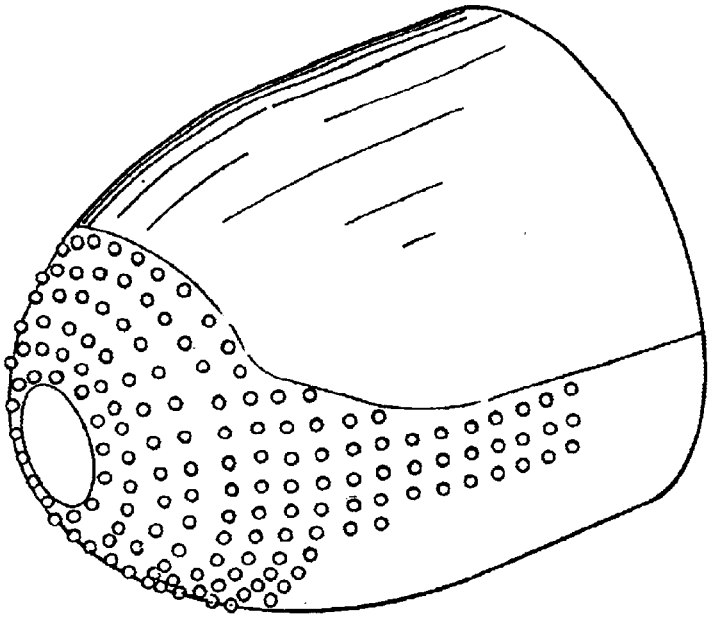
FIG.1a
FIG.1b
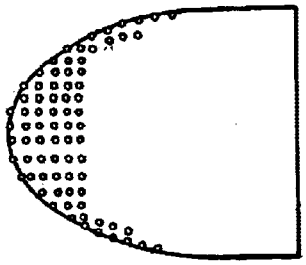
FIG.1c
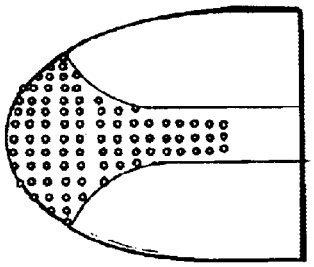
FIG.1d
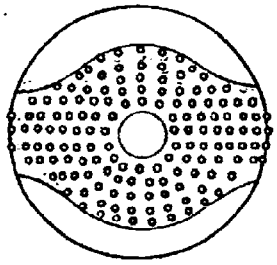

TORPEDO SONAR COMPRISING A PLURALITY OF ACOUSTIC TRANSDUCERS

CROSS REFERENCE TO RELATED APPLICATION

This application is a continuation of application Ser. No. 10/051,329 filed Oct. 22, 2001 now abandoned.

FIELD OF THE INVENTION

The present invention relates to a torpedo sonar apparatus comprising a plurality of electro-acoustic transducers or hydrophones and, more particularly, relates to a torpedo sonar having those transducers arranged in several zones along a hemispherical or paraboloid-shaped torpedo bow.

BACKGROUND OF THE INVENTION

Two basic types of transducer arrays are used for acoustic target searching for torpedoes. The first type of torpedo sonar has its transducers located at a flattened front surface of the torpedo head. In the second type the transducers are arranged along the curved contour of the torpedo head, sometimes called a conformal array. British patent GB 2 234 815 B shows both types of arrays. In a first embodiment (FIG. 1) several transmission transducers are arranged in a narrow vertical column on a flat central front surface of a hemispherical or paraboloid-shaped torpedo head, and several reception transducers are arranged in a narrow horizontal line on the flat front surface. Both groups of transducers together form a cross-like arrangement. The vertical transmission transducer column generates a flat fan-shaped transmission beam which is broadly distributed in horizontal direction but sharply focused in vertical direction. The horizontal reception transducer line generates a flat reception diagram which is broadly distributed in vertical direction and is narrow in horizontal direction. Both, the transmission beam and the reception diagram can be tilted electronically. In a second embodiment (FIG. 5a) GB 2 234 815 B shows the transducers of said column and/or line arranged along the curved contour of the torpedo head. Further conformal arrays of torpedo sonar transducers are described in U.S. Pat. No. 3,906,431 and in German published patent application DE 33 22 246 A1.

Providing a flat torpedo front surface increases the flow resistance of the torpedo and thus requires more energy for moving the torpedo ahead through the water. However, such an arrangement of the transducers at a flat front surface essentially reduces the number of individual transducers required for generating a particular antenna pattern and facilitates the calculations for beam forming. Because of the limitations with respect to the available size of a flat front surface, the possible number of transducers is strictly limited as well. This results in a restricted angular resolution of the sonar. Furthermore, the angular range of such sonar is limited to about ±45° or, if some ambiguities are acceptable, to about ±60°.

When using a conformal array, the streamlined contour of the torpedo head is not impaired so that the hydrodynamic resistance of the torpedo can be optimized. In addition the angular searching range of the sonar can be essentially larger than that of a flat front surface transducer array. The maximum unambiguous angular search range is about ±135°, and can be extended to about ±150° if some ambiguities are acceptable. In order to achieve such wide search angles in horizontal as well as in vertical direction, a large number of individual transducers is required. The active surface of a conformal array torpedo sonar is essential larger than that of a torpedo sonar on a flattened front portion of the torpedo head. Since the active sonar surface is completely filled with transducers, a conformal array torpedo sonar needs essential more transducers than a flat-head sonar.

OBJECTS OF THE INVENTION

It is an object of the invention to combine the advantages of both types of torpedo sonars and to simultaneously minimize the number of required transducers.

It is another object of the invention to provide a torpedo sonar which has wide angular search ranges in horizontal direction as well as in vertical direction.

It is a further object of the invention to create a torpedo sonar which is useful also in deep water.

SUMMARY OF THE INVENTION

These and other objects and advantages are achieved by the invention in that a torpedo sonar comprising a plurality of acoustic transducers has those transducers arranged in several zones along the curved surface of the torpedo bow in such a configuration that a first circular transducer zone covers the vertex region of the torpedo head and a second ring-shaped transducer zone surrounds said first zone. A lateral third transducer zone is provided at each side of the torpedo yaw axis and extends from said second zone backwards but ends before reaching the great circle of the torpedo head. A lateral fourth transducer zone at both sides of the torpedo yaw axis extends between said third zones and said great circle. This configuration leads to an acceptable minimum of required transducers. For searching purposes these transducers will be passive, i.e. receiver transducers converting ultra-sound waves into electrical signals. Some of the transducers might be active, i.e. transmitter transducers converting electrical driver signals into ultra-sound waves. Other transducers might be dual function transducers, which are alternatingly used for reception or transmission.

Preferably, the lateral third zones are formed as transition zones being broader adjacent the second zone and being narrower adjacent the fourth zones so that a smooth transition appears into the width of the fourth zone. In a particular useful embodiment of the invention the first zone extends over 1.5 $\lambda$ measured from the apex of the torpedo bow, wherein $\lambda$ is the design wavelength of the sonar. Said second zone then extends from 2.0 $\lambda$ to 5 $\lambda$, and said third zone extends to a distance of 7 $\lambda$ measured from the apex of the torpedo head, which has a hemispherical or paraboloid-shaped or otherwise steadily curved contour. If the forward-looking component of the search signal is of less importance, there might be provided no transducers in the first zone, the vertex zone. If on the other hand, active locating or tracking of targets ahead of the torpedo is required, said first zone can be provided with transmitter transducers. In cases where an extension of the horizontal search range over more than ±90° is not desired, transducers in said fourth zones can be omitted or reduced by number. In other cases it can be useful to extend said fourth zones backwards beyond the great circle. For some applications it might be necessary to extend the vertical searching angular range at least in the area of small horizontal search angles. For this purpose an embodiment of the invention has a further set of two of said third-type and fourth-type zones (forming fifth and sixth zones) arranged at the top and/or at the bottom side of the torpedo. If the water surface or objects between it and the torpedo are to be searched or imaged, then it will be sufficient to provide transducers in a further third-type zone and a further fourth-type zone (fifth and sixth zones, respectively) arranged only at the top side of the torpedo.

BRIEF DESCRIPTION OF THE DRAWING

An embodiment of the invention will now be described with reference to the accompanying drawings, wherein FIG. 1*a* is a schematic perspective view also representing a torpedo head comprising four transducer zones;

FIG. 1*b* is a view of the head on its top side,

FIG. 1*c* is a view of the head on its left side,

FIG. 1*d* is a view on its front surface; and

SPECIFIC DESCRIPTION

Figure 2:
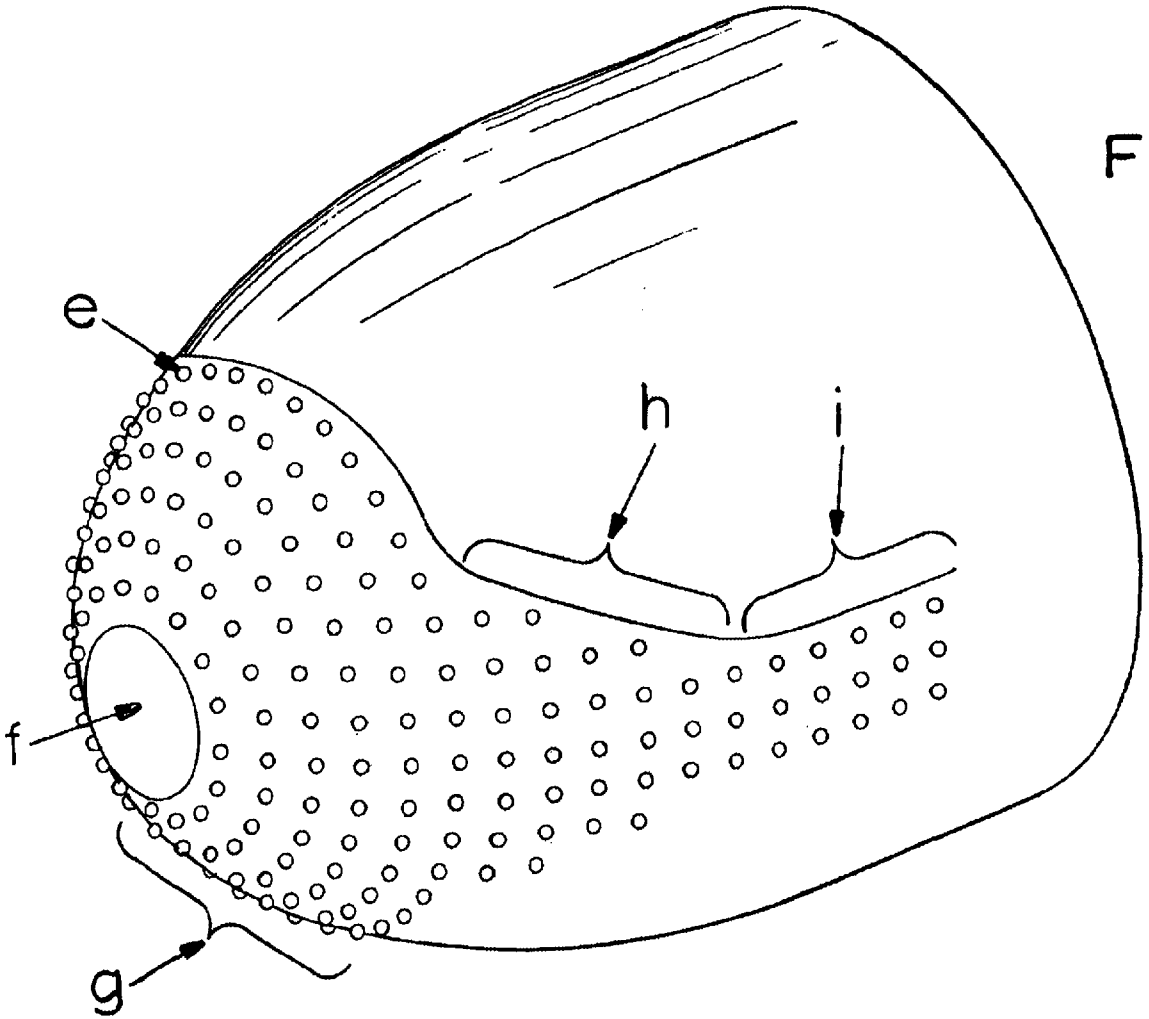
FIG. 2 shows an enlarged representation of the perspective view of FIG. 1*a* with its four transducer zones (f)–(i).

The sonar sensor array of the shown embodiment consists of 256 individual transducers (e). Depending on the selected design frequency of the sonar a different number of transducers might be used, e.g. a smaller number at lower design frequencies, or a larger number for higher design frequencies. The number of transducers mainly depends on the desired spatial range of detection.

A circular first zone (f) is provided surrounding the apex of the torpedo head. In the shown embodiment this first zone is free of transducers (e). This empty first zone mainly is used for reducing the number of transducers. Transducers located in this zone would not essentially contribute to the direction diagram of the sonar and therefore can be omitted without impairing the reception pattern of such sonar. If, e.g. for target tracking, a beam of ultra-sound waves is to be sent in forward direction, some active transducers might be located within vertex zone (f). When using such separate transmitter transducers a transmitter/receiver switch is not required.

Following said circular first zone (f) is a ring-shaped second zone (g) whose transducers care for achieving a large and uniform direction diagram of the sonar in vertical as well as in horizontal direction, i.e. about the pitch and the yaw axis of the torpedo. By arranging transducers (e) in zone (q) along the curved surface of the torpedo head, the angular detection range is essentially increased in relation to a structure having its transducers located on a flattened front surface of the torpedo head. The uniformity of the directive diagram is a result of the rotational symmetry of the transducer array around the longitudinal axis of the torpedo. If an extended angular detection range is required, this ring-shaped second zone (g) may be made larger in axial direction. This, however, would require more transducers.

At the backward end of this ring-shaped second zone (g), the rotational symmetry of the array is terminated. On both sides of the torpedo head a transition zone (h) follows as a third zone. These two lateral transition zones are provided at both sides of the torpedo yaw axis and extend from said second zone backwards. Third zones (h) are axial symmetric with respect to each other, but are not rotational symmetric. As shown in the drawings, these transition zones (h) are broader adjacent said second zone and are smaller at their rear end. Said third zones (h) transfer the uniform rotational directive diagram of zone (g) into two side-looking lateral directive diagrams extending at both sides of the horizontal axis of the torpedo. The signals generated by the transducers of such lateral transducer zones can be evaluated much easier by a direction finding processor of the torpedo sonar than target data signals obtained from a rotational symmetric array.

The end portion of the transducer zones is formed by two lateral fourth zones (i) extending at both sides of the torpedo from said third zone backwards at least to the great circle of the torpedo head. These fourth zones preferably have a constant width over their entire length and, if necessary can be extended into the rear portion of the torpedo shell. If only a horizontal angular detection range of ±90° is to be searched, this fourth zone may be left free of transducers, so that the number of transducers is further decreased.

When designing the transducer array ($\lambda$ being the design wavelength of the sonar) it is recommended, after selecting an appropriate design frequency, to proceed from the apex of the hydrodynamically determined torpedo contour backwards in steps of $\lambda/2$. The first zone (f) around the apex preferably should extend to 1.5 $\lambda$.

Beginning at a distance of 2 $\lambda$ from said apex several rings of transducers will be arranged on the surface of the torpedo head around its longitudinal axis. These transducer rings constitute said ring-shaped second zone (g). The distance between adjacent transducers is $\lambda/2$. For keeping the total number of transducers small, ring-shaped second transducer zone should end at about 5 $\lambda$.

In the transition zone (h) extending to a distance of about 7 $\lambda$ from said apex the calculated positions of the individual transducers are reduced to a minimum as required for achieving the desired minimum angular resolution and for providing a uniform transition into the width of the fourth zone (i). This fourth zone extends at least to the beginning of the straight torpedo head contour at the great circle of the torpedo bow.

Depending on the particular application and objective of the torpedo sonar, its desired angular resolution, and its angular detection ranges, the size of said zones and the number and/or distribution of transducers within said zones may be modified.

I claim:

1. A torpedo sonar apparatus comprising a plurality of acoustic transducers arranged in several zones along the curved surface of the torpedo bow, such that a) a circular first zone covers the vertex region of the torpedo bow;

b) a ring-shaped second zone surrounds said first zone;

c) a lateral third zone is provided on each side of the torpedo yaw axis, said third zones extending from said second zone backwards but ending before reaching the great circle of the torpedo head; and d) a lateral fourth zone on each side of the torpedo yaw axis extends between said third zone and said great circle, each of a plurality of said zones having respective groups of said transducers in spaced-apart relationship and distributed over the respective zones.

2. The torpedo sonar of claim 1, wherein a) said first zone has a first group of said transducers and extends in axial direction of the torpedo from the apex of the torpedo bow to a distance corresponding to about 1.5 $\lambda$, with $\lambda$ being the design wavelength of the sonar;

b) said second zone has a second group of said transducers and extends from 2.0$\lambda$ to 5$\lambda$; and c) said third zone has a third group of said transducers and extends to 7$\lambda$.

3. The torpedo sonar of claim 1, wherein a) said first zone has no transducers and extends in axial direction of the torpedo from the apex of the torpedo bow to a distance corresponding to about 1.5 $\lambda$, with $\lambda$ being the design wavelength of the sonar;

b) said second zone has a second group of said transducers and extends from 2.0λ to 5λ.; and c) said third zone has a third group of said transducers and extends to 7λ.

4. The torpedo sonar of claim 1 wherein said zones all have respective groups of said transducers and wherein said fourth zones extend beyond said great circle.

5. The torpedo sonar of claim 1 wherein said second, third and fourth zones have respective groups of said transducers and wherein said fourth zones extend beyond said great circle.

6. The torpedo sonar of claim 1 wherein said zones all have respective groups of said transducers and said lateral third zones are transition zones which are broader adjacent said second zone and being smaller adjacent said fourth zones.

7. The torpedo sonar of claim 1 wherein at least said second and third zones have respective groups of said transducers and said lateral third zones are transition zones which are broader adjacent said second zone and being smaller adjacent said fourth zones.

8. The torpedo sonar of claim 1 having no transducers provided in said first zone.

9. The torpedo sonar of claim 1 wherein said zones all have respective groups of said transducers and the transducers in said first zone are transmitter transducers.

10. The torpedo sonar of claim 1 having no transducers provided in said fourth zones.

11. The torpedo sonar of claim 1 having a fifth zone of the type of said third zones and having a sixth zone of the type of said fourth zones provided at a top side of said torpedo head and wherein said zones all have respective groups of said transducers.

12. The torpedo sonar of claim 8 having a fifth zone of the type of said third zones and having a sixth zone of the type of said fourth zones provided at a top side of said torpedo head and wherein said zones all have respective groups of said transducers.

13. The torpedo sonar of claim 1 having a fifth zone of the type of said third zones and having a sixth zone of the ( type of said fourth zones provided at a bottom side of said torpedo head and wherein said zones all have respective groups of said transducers.

14. The torpedo sonar of claim 8 having a fifth zone of the type of said third zones and having a sixth zone of the type of said fourth zones provided at a bottom side of said torpedo head and wherein said zones all have respective groups of said transducers.

* * * * *